US006260768B1

(12) United States Patent
Timms

(10) Patent No.: US 6,260,768 B1
(45) Date of Patent: Jul. 17, 2001

(54) PUMP INJECTOR INCLUDING VALVE NEEDLE AND SPILL VALVE

(75) Inventor: Colin Thomas Timms, Harrow Weald (GB)

(73) Assignee: Lucas Industries, London (GB)

( * ) Notice: Subject to any disclaimer, the term of this patent is extended or adjusted under 35 U.S.C. 154(b) by 0 days.

(21) Appl. No.: 09/395,715

(22) Filed: Sep. 14, 1999

(30) Foreign Application Priority Data

Sep. 16, 1998 (GB) ..... 9820033

(51) Int. Cl.[7] ..... F02M 47/02

(52) U.S. Cl. ..... 239/88; 239/96; 239/127; 239/533.9; 239/585.1; 251/129.1; 123/447

(58) Field of Search ..... 239/88, 89, 90, 239/91, 96, 127, 533.2, 533.8, 533.9, 585.1, 585.4; 123/446, 447, 467, 506; 285/374, 397, 399; 417/470, 559; 251/129.1

(56) References Cited

U.S. PATENT DOCUMENTS 4,129,253 12/1978 Bader, Jr. et al. .
4,448,169 * 5/1984 Badgley et al. ..... 239/89 X
4,628,881 * 12/1986 Beck et al. ..... 239/96 X
5,413,081 * 5/1995 Collingborn ..... 123/506
5,915,623 * 6/1999 Knight et al. ..... 239/88
6,012,430 * 1/2000 Cooke ..... 239/96 X

FOREIGN PATENT DOCUMENTS 0845791 3/1998 (EP) .

* cited by examiner

*Primary Examiner*—David A. Scherbel
*Assistant Examiner*—Steven J. Ganey
(74) *Attorney, Agent, or Firm*—Wells, St. John, Roberts, Gregory & Matkin, P.S.

(57) ABSTRACT

A pump injector comprising a pumping chamber, a valve needle controlling communication between the pumping chamber and one or more outlet openings, and a spill valve controlling communication between the pumping chamber and a low pressure fuel reservoir, in use. The pump injector also comprises an inlet non-return valve arranged to permit fuel to flow from the fuel reservoir to the pumping chamber, in use, but substantially preventing fuel flow in the reverse direction. Alternatively, the pump injector may comprise an abutment piston engageable with the valve needle which defines, in part, a control chamber for fuel, and a control valve controlling communication between the pumping chamber and the control chamber.

15 Claims, 2 Drawing Sheets

PUMP INJECTOR INCLUDING VALVE NEEDLE AND SPILL VALVE

Figure 1:
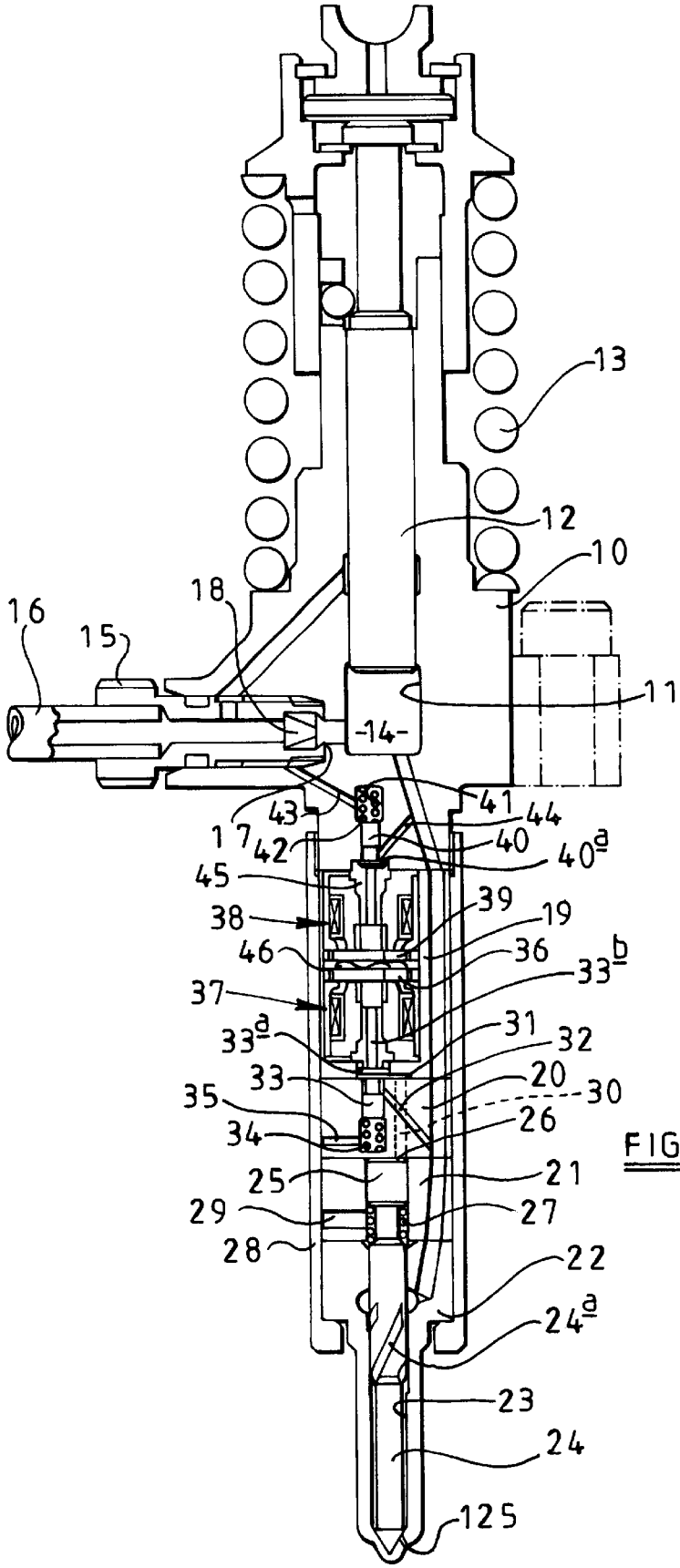

This invention relates to a fuel injector for use in supplying fuel under high pressure to a combustion space of an associated engine. In particular, the invention relates to a unit pump injector.

In a known unit pump injector, a valve needle is spring biased into engagement with a seating to control the delivery of fuel. The needle includes thrust surfaces which are exposed to fuel at substantially the output pressure of a pump upon which a nozzle body including a bore within which the needle is slidable is mounted. A spill valve is used to control the timing of commencement of fuel pressurization and to control the timing of termination of fuel injection.

In such an arrangement, charging of the pump occurs through the spill valve. Where the injector is designed to be received within a bore of approximately 17 mm diameter, the spill valve is of small dimensions. Such a spill valve may be incapable, throughout the engine speed range, of allowing sufficient fuel to flow to the pump in the time available during the filling cycle of the pump. Further, at the termination of injection, the fuel may be unable to escape at a sufficiently high rate to ensure that the needle moves into engagement with its seating at a desired rate and remains in engagement with its seating; again when the engine and the injector are operating at high speeds.

It is an object of the invention to provide an injector suitable for use in such an application in which these disadvantages are overcome or of reduced effect.

According to a first aspect of the invention there is provided a pump injector comprising a pumping chamber, a valve needle controlling communication between the pumping chamber and at least one outlet opening, a spill valve controlling communication between the pumping chamber and a low pressure reservoir, in use, and an inlet non-return valve arranged to permit fuel to flow from the low pressure reservoir to the pumping chamber, in use, but substantially preventing fuel flow in the reverse direction.

In such an arrangement filling of the pumping chamber in the time available can be achieved, even when the spill valve is of small dimensions, as fuel is able to by-pass the spill valve, flowing through the inlet non-return valve to the pumping chamber.

The valve needle may be engageable with an abutment piston, the abutment piston defining, in part, a control chamber, a control valve controlling communication between the pumping chamber and the control chamber.

Such an arrangement is advantageous in that, when the spill valve is opened to terminate injection, the control valve can also be opened to apply relatively high pressure to the abutment piston resulting in movement of the piston to increase the magnitude of the force urging the needle into engagement with its seating and reducing the risk of the needle lifting from its seating at a subsequent point in the operating cycle of the unit pump injector.

According to a second aspect of the invention there is provided a pump injector comprising a valve needle engageable with a seating to control communication between a pumping chamber and at least one outlet opening, a spill valve controlling communication between the pumping chamber and a fuel reservoir, in use, an abutment piston engageable with the needle and which defines, in part, a control chamber, a control valve controlling communication between the pumping chamber and the control chamber.

Figure 2:
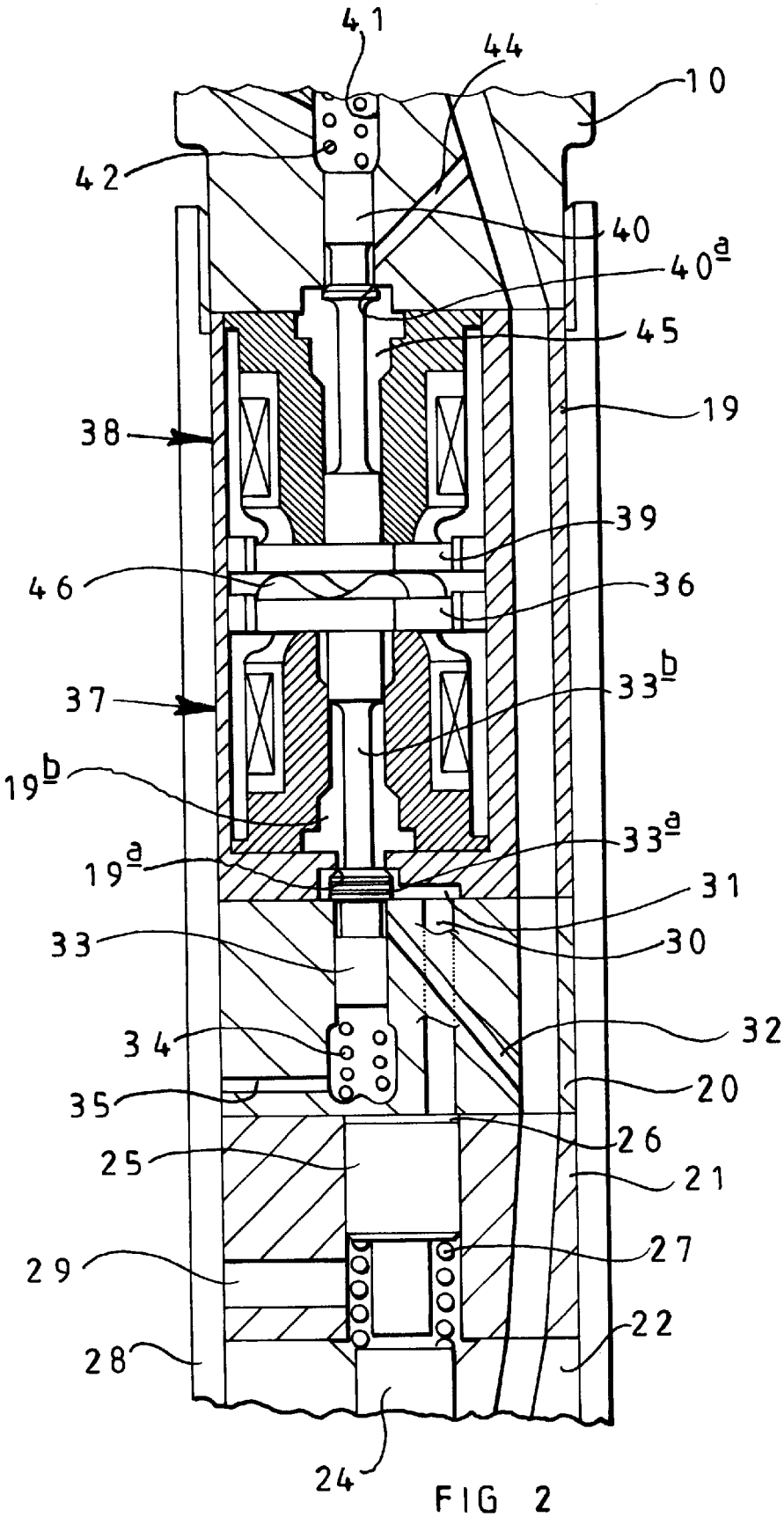

The invention will further be described, by way of example, with reference to the accompanying drawings, in which:

FIG. 1 is a sectional view illustrating a unit pump injector in accordance with an embodiment of the invention; and FIG. 2 is an enlargement of part of FIG. 1.

The fuel injector illustrated in the accompanying drawing takes the form of a unit pump injector of small diameter for use in a fuel system for an engine of the type in which small diameter, eg 17 mm, bores are formed in the cylinder head for receiving the injectors. The injector comprises a pump housing 10 having a plunger bore 11 formed therein, a plunger 12 being reciprocable within the bore under the action of a cam and tappet arrangement (not shown), a return spring 13 being arranged to retract the plunger 12 from the bore 11. The plunger 12 and bore 11 together define a pumping chamber 14 to which fuel can be supplied through an inlet coupling arrangement 15 whereby a low pressure fuel pipe 16 is connected to the pump housing 10. The inlet arrangement 15 includes a relatively large diameter bore 17 which communicates with the bore of the pipe 16, and within which an inlet valve member 18 is slidable. The inlet valve member 18 is engageable with a lift stop defined at the interconnection of the relatively large diameter part of the bore 17, and a part of the pump housing 10 to prevent the member 18 from entering the pumping chamber 14. The other end of the member 18 is sealingly engageable with a seating defined by the inlet arrangement 15 to substantially prevent fuel from flowing, in use, from the pumping chamber 14 through the inlet valve towards the pipe 16. Flow of fuel in the reverse direction to charge the pumping chamber 14 with fuel from the pipe 16 is permitted by the valve member 18 lifting from its seating, the valve member 18 being shaped to include flutes through which the fuel can flow, once the valve member 18 is lifted from its seating.

The pumping chamber 14 communicates through a supply passage defined by drillings formed in an actuator housing 19 a control valve housing 20, a control chamber housing 21 and a nozzle body 22 with a stepped blind bore 23 formed in the nozzle body 22. A valve needle 24 is slidable within the bore 23, the needle 24 and bore 23 together defining a delivery chamber. The needle 24 includes thrust surfaces which are exposed to the fuel pressure within the delivery chamber and orientated such that when fuel under pressure is applied to the delivery chamber, a force is applied to the needle 24 urging the needle 24 away from a seating defined adjacent a blind end of the bore 23 to permit fuel to flow past the seating to one or more outlet openings 125 located downstream of the seating.

The needle 24 includes a guide region of diameter substantially equal to the diameter of the adjacent part of the bore 23, engagement between the guide region of the needle 24 and the wall of the bore 23 guiding the needle 24 for sliding movement within the nozzle body 22 to ensure that the needle 24 remains substantially concentric with the seating. In order to permit fuel to flow from the supply passage to the delivery chamber, the needle 24 is provided with a series of flutes 24*a*.

The control chamber housing 21 is provided with a through bore which extends coaxially with the blind bore 23 of the nozzle body 22, and within which a spring abutment piston 25 is slidable. The spring abutment piston 25 and the bore of the control chamber housing 21 together defining a control chamber 26. A spring 27 is engaged between the spring abutment piston 25 and a surface of the needle 24, the spring 27 biasing the needle 24 towards a closed position in which the needle engages its seating. The part of the bore of the control chamber housing 21 within which the spring 27 is located is vented to a low pressure chamber defined, in part, between the control chamber housing 21 and a cap nut 28 by means of a passage 29 provided in the control chamber housing 21. The low pressure chamber conveniently communicates with a low pressure fuel reservoir or drain either through the pipe 16 or through a separate passage. The cap nut 28 is in engagement with the pump housing 10, the cap nut clamping the nozzle body 22 and the various other housing parts of the injector to the pump body 10.

The control valve housing 20 is provided with a drilling 30 which communicates with the control chamber 26, the drilling 30 communicating with a chamber 31 defined between the control valve housing 20 and the actuator housing 19. The control valve housing 20 further includes a drilling 32 extending from the part of the supply passage extending through the control valve housing 20 to a blind bore formed in the control valve housing 20. A control valve member 33 is slidable within the blind bore of the control valve housing 20, the control valve member 33 including a region which is of piston-like fit within the bore, a spring 34 being engaged between the blind end of the bore and this part of the control valve member 33. The blind end of the bore is vented to the low pressure chamber through a drilling 35.

The control valve member 33 further includes a region 33*a* of relatively large diameter, shaped to be engageable with the open end of the blind bore to control communication between the drilling 32 and the chamber 31. The seating diameter of the control valve is conveniently equal to the diameter of the bore within which the control valve member 33 is slidable so that the valve is substantially pressure balanced when closed. The region 33*a* is further shaped to include a region which is sealingly engageable with a step 19*a* defined by the actuator housing 19 to control communication between the chamber 31 and a chamber 19*b* defined by the housing 19 which is vented to the low pressure reservoir. The seating diameter is substantially equal to the diameter of the bore within which the member 33 is slidable. It will therefore be appreciated that the control valve controls communication between the pumping chamber 14 and the control chamber 26. In use, when the pumping chamber 14 is at relatively high pressure, if the control valve is open, then high pressure fuel is applied to the control chamber 26, urging the spring abutment piston 25 in a direction which first compresses the spring 27, and then results in the spring abutment member acting directly upon the needle to force the needle 24 towards its seating.

The control valve member 33 includes an extension 33*b* which carries an armature 36 moveable under the influence of a magnetic field generated, in use, by a first electromagnetic actuator 37 located within the actuator housing 19. The actuator housing 19 further houses a second actuator 38 which is operable to control the position of a second armature 39 coupled to a spill valve member 40 slidable within a bore 41 formed in the pump housing 10. A spring 42 is located within a blind end of the bore 41 to bias the spill valve member 40 towards a position in which an enlarged diameter region 40*a* thereof is spaced from a seating defined around an open end of the bore 41.

The part of the bore 41 containing the spring 42 is vented via a drilling 43 to part of the inlet connector arrangement 15 carrying fuel at relatively low pressure.

A drilling 44 provides a flow path between the supply passage and the bore 41, the spill valve member 40 being engageable with its seating to control communication between the drilling 44 and a chamber 45 located within the actuator housing 19 which communicates with the low pressure chamber, and hence with, for example, the pipe 16.

A spring 46 conveniently of wave-like form is located between the armatures 36, 39. It will be appreciated that the spring 46 applies a force to each of the spill valve member 40 and the control valve member 33 urging the spill valve member 40 and control valve member 33 towards their closed positions. However, the rate of the spring 46, and pre-loading thereof, are chosen to ensure that the springs 34, 41 are able to move the drain valve member 33 and spill valve member 40, respectively, to their open positions.

In use, starting from the position shown in which the plunger 12 occupies substantially its outermost position, and with the actuators 37, 38 de-energized, the pumping chamber 14 is charged with fuel to a relatively low pressure. Inward movement of the plunger 12 under the action of the cam and tappet arrangement displaces fuel from the pumping chamber to the supply passage, and through the drilling 44 to the chamber 45 past the spill valve member 40, returning fuel to the low pressure fuel reservoir through, for example, the pipe 16. It will be appreciated, therefore, that the fuel pressure within the supply passage, and in particular the fuel pressure within the delivery chamber is relatively low, and is insufficient to lift the needle 24 away from its seating against the action of the spring 27 at low speeds, and at higher speeds, as the control chamber 26 communicates with the supply passage, any increase in fuel pressure within the delivery chamber is accompanied by a rise in the control chamber pressure, thus the needle does not lift from its seating.

When it is determined that pressurization of fuel should commence, the second actuator 38 is energized, attracting the armature 39 thereto and moving the spill valve member 40 against the action of the spring 41 to bring the enlarged diameter region 40*a* thereof, into engagement with its seating. Such movement of the spill valve member 40 breaks the communication between the drilling 44 and the chamber 45. Fuel is therefore no longer permitted to escape to the low pressure drain reservoir, and pressurization of the fuel within the pumping chamber 14 and the passages in communication therewith commences. It will be appreciated that during this phase of the operating cycle of the fuel injector, the inlet valve member 18 will be pushed into engagement with its seating by the fuel pressure within the pumping chamber 14, thus fuel is unable to flow from the pumping chamber 14 to the inlet pipe 16.

At the same time as the second actuator 38 is energised, the first actuator 37 is also energised resulting in the communication between the pumping chamber 14 of the control chamber 26 being broken, and in the region 33*a* lifting from the step 19*a* to connect the control chamber 26 to the low pressure reservoir, and as a result, the fuel pressure within the control chamber 26 is relatively low.

As the plunger 12 continues to move inward under the action of the cam and tappet arrangement, the fuel pressure within the delivery chamber will rise, and a point will be reached beyond which the fuel pressure within the delivery chamber is sufficient to lift the needle 24 away from its seating against the action of the spring 27. As a result, fuel will be able to flow to the outlet openings 125, thus delivery of fuel takes place. As the needle lifts, it moves the abutment piston 25, displacing fuel flow from the control chamber 26 to the chamber 19*b* and the low pressure reservoir until the needle reaches its fully lifted position which is determined by the length of the abutment piston 25.

Once the desired quantity of fuel has been delivered, fuel injection is terminated by de-energizing the second actuator 38, the spill valve member 40 moving under the action of the spring 41 to permit communication between the pumping chamber 14 and the low pressure drain reservoir. The fuel pressure within the pumping chamber 14 and the passages in communication therewith will rapidly fall, and a point will be reached beyond which the fuel pressure within the delivery chamber is no longer sufficient to maintain the needle 24 in its lifted position, the needle 24 being urged by the spring 27 towards its closed position.

After termination of injection, continued inward movement of the plunger 12 continues to displace fuel from the pumping chamber 14 to the low pressure drain. Where the engine to which fuel is being delivered is operating at high speed, and hence the plunger 12 is moving rapidly, the rate at which fuel is able to flow past the spill valve to the low pressure drain may be insufficient to allow the needle to return into engagement with its seating at the desired rate, and may be insufficient to prevent the fuel pressure within the delivery chamber rising to an extent sufficient to allow the needle 24 to lift from its seating against the action of the spring 27. In order to reduce the risk of the needle 24 moving in this manner, upon termination of injection, the first actuator 37 is de-energized at around the same time as the second actuator 38 to permit fuel from the supply line to flow to the control chamber 26, thus pressurizing the control chamber and applying a force to the spring abutment piston 25, urging the piston 25 in a direction compressing the spring 27, until the piston 25 engages the needle, and then acting directly upon the needle to increase the load applied to the needle 24 urging the needle 24 towards its seating. As illustrated in the accompanying drawings, the spring abutment piston 25 is of relatively large diameter, thus the application of fuel under relatively high pressure to the control chamber 26 applies a relatively large magnitude force to the needle 24. As a result, the risk of undesirable movement of the needle 24 is reduced.

The timing at which the actuator of the control valve is de-energized relative to that of the spill valve may be adjusted, depending upon the application in which the injector is to be used, to modify the injection characteristics at the end of injection.

After the plunger 12 has reached its innermost position, retraction of the plunger under the action of the return spring 13 commences. The movement of the plunger 12 draws fuel from the chamber 45 past the spill valve 40 to the drilling 44 and from there to the pumping chamber 14. However, the dimensions of the spill valve arrangement are sufficiently small that fuel may be unable to flow to the pumping chamber 14 at a sufficient high rate to charge the pumping chamber 14 in the time available. In the event of the rate at which fuel is supplied to the pumping chamber 14 being insufficient, the movement of the plunger 12 under the action of the return spring 13 will result in the fuel pressure within the pumping chamber 14 falling below that present within the supply pipe 16, and as a result the inlet valve element 18 will lift from its seating, thus permitting fuel to flow from the inlet pipe 16 past the inlet valve member 18 to the pumping chamber 14, by-passing the spill valve arrangement. It will thus be appreciated that even when the fuel injector is operating at high speeds, it is possible to charge the pumping chamber 14 to the desirable level in the time available, and it is also possible to avoid injection of fuel at inappropriate points in the operating cycle of the injector.

As discussed hereinbefore, the risk of insufficient fuel being able to flow to the pumping chamber in the time available during filling of the pump, and the risk of injection of fuel at undesirable points in the operating cycle of the injector are relatively large where the spill valve arrangement is designed to be of small diameter, for example where the injector is intended for use in a small diameter bore formed in an engine cylinder head, for example a bore of 17 mm diameter. In such an arrangement, the diameter of the spill valve member 40 is likely to be of the order of 2 mm diameter. Although the disadvantages set out hereinbefore are most relevant to an injector for use in a small diameter engine cylinder head bore, it will be appreciated that the invention is also applicable to other types of pump injector.

The arrangement described hereinbefore may be modified in a number of ways. For example, the inlet arrangement may take the form of a component arranged to extend within a bore formed in the cylinder head rather than taking the form of a coupling arranged to be secured to the pump housing in a screw-threaded manner.

What is claimed is:

1. A pump injector comprising a pumping chamber, a valve needle controlling, in use, communication between said pumping chamber and one or more outlet openings, a housing for an actuator for controlling operation of a control valve, a spill valve controlling communication between said pumping chamber and a low pressure fuel reservoir, in use, the spill valve being located between the pumping chamber and the actuator housing, and an inlet non-return valve arranged to permit fuel to flow from said fuel reservoir to said pumping chamber, in use, but substantially preventing fuel flow in the reverse direction, wherein said valve needle is engageable with an abutment piston which defines, in part, a control chamber for fuel, and further comprising the control valve for controlling communication between said pumping chamber and said control chamber.

2. The pump injector as claimed in claim 1, wherein said abutment piston has a relatively large diameter.

3. The pump injector as claimed in claim 1, wherein said inlet non-return valve includes a valve member which is sealingly engageable with a seating defined by an inlet arrangement to substantially prevent, in use, fuel flow from said pumping chamber to said fuel reservoir.

4. The pump injector as claimed in claim 3, wherein said inlet arrangement takes the form of a coupling arrangement to be secured to a pump injector housing.

5. The pump injector as claimed in claim 1, wherein said control valve includes a valve member which is slidable within a blind bore having an open end, said control valve member being engageable with a seating defined by said open end to control communication between said pumping chamber and said control chamber.

6. The pump injector as claimed in claim 5, wherein said seating defined by said open end has a seating diameter which is substantially equal to the diameter of the bore.

7. The pump injector as claimed in claim 1, wherein the pumping chamber is defined within a pump housing and wherein the spill valve is housed within the pump housing.

8. A pump injector comprising a pumping chamber, a valve needle controlling, in use, communication between said pumping chamber and one or more outlet openings, a spill valve controlling communication between said pumping chamber and a low pressure fuel reservoir, in use, and an inlet non-return valve arranged to permit fuel to flow from said fuel reservoir to said pumping chamber, in use, but substantially preventing fuel flow in the reverse direction, wherein said inlet return valve includes a valve member which is sealingly engageable with a seating defined by an inlet arrangement to substantially prevent, in use, fuel flow from said pumping chamber to said fuel reservoir, wherein said inlet arrangement takes the form of a coupling arrangement to be secured to a pump injector housing.

9. A pump injector comprising a pumping chamber, a valve needle controlling communication between said pumping chamber and one or more outlet openings, a housing for an actuator for controlling operation of a control valve, a spill valve controlling communication between said pumping chamber and a low pressure fuel reservoir, in use, the spill valve being located between the pumping chamber and the actuator housing, and an inlet non-return valve arranged to permit fuel to flow from said fuel reservoir to said pumping chamber, in use, but substantially preventing fuel flow in the reverse direction, wherein the pumping chamber is defined within a pump housing and wherein the spill valve is housed within the pump housing.

10. The pump injector as claimed in claim 9, wherein said valve needle is engageable with an abutment piston which defines, in part, a control chamber for fuel, and further comprising the control valve for controlling communication between said pumping chamber and said control chamber.

11. The pump injector as claimed in claim 10, wherein said abutment piston has a relatively large diameter.

12. The pump injector as claimed in claim 10, wherein said control valve includes a valve member which is slidable within a blind bore having an open end, said control valve member being engageable with a seating defined by said open end to control communication between said pumping chamber and said control chamber.

13. The pump injector as claimed in claim 12, wherein said seating defined by said open end has a seating diameter which is substantially equal to the diameter of the bore.

14. The pump injector as claimed in claim 9, wherein said inlet non-return valve includes a valve member which is sealingly engageable with a seating defined by an inlet arrangement to substantially prevent, in use, fuel flow from said pumping chamber to said fuel reservoir.

15. The pump injector as claimed in claim 14, wherein said inlet arrangement takes the form of a coupling arrangement to be secured to a pump injector housing.

* * * * *